US006483472B2

(12) United States Patent
Cipolla et al.

(10) Patent No.: US 6,483,472 B2
(45) Date of Patent: Nov. 19, 2002

(54) MULTIPLE ARRAY ANTENNA SYSTEM

(75) Inventors: Frank W. Cipolla, Newbury Park, CA (US); John Sclimenti, Agoura, CA (US); John DiGioia, Agoura Hills, CA (US)

(73) Assignee: Datron/Transo, Inc., Simi Valley, CA (US)

( * ) Notice: Subject to any disclaimer, the term of this patent is extended or adjusted under 35 U.S.C. 154(b) by 0 days.

(21) Appl. No.: 09/759,050

(22) Filed: Jan. 11, 2001

(65) Prior Publication Data

US 2001/0026245 A1 Oct. 4, 2001

Related U.S. Application Data

(60) Provisional application No. 60/175,383, filed on Jan. 11, 2000.

(51) Int. Cl.[7] ..... H01Q 19/18
(52) U.S. Cl. ..... 343/765; 343/853
(58) Field of Search ..... 343/765, 776, 343/781 P, 836, 837, 840, DIG. 2, 853; H01Q 19/10, 19/18

(56) References Cited

U.S. PATENT DOCUMENTS

| | | | | |
|---|---|---|---|---|
| 1,821,380 A | * | 9/1931 | Franklin | 343/836 |
| 1,932,469 A | * | 10/1933 | Leib et al. | 343/836 |
| 2,408,825 A | * | 10/1946 | Varian et al. | 343/765 |
| 3,147,479 A | * | 9/1964 | Williams | 343/836 |
| 3,386,099 A | | 5/1968 | Walter et al. | |
| 5,781,163 A | | 7/1998 | Ricardi et al. | |

* cited by examiner

*Primary Examiner*—Michael C. Wimer
(74) *Attorney, Agent, or Firm*—Edward A. Sokolski

(57) ABSTRACT

An antenna system suitable for use in communicating with satellites has multiple antenna units adjacent to each other and oriented in the same direction. These antenna units are driven together in tandem in altitude and azimuth by a common drive unit. The signals received by the antenna are combined together in an in phase relationship in a combiner unit to provide received signals which reinforce each other.

5 Claims, 4 Drawing Sheets

MULTIPLE ARRAY ANTENNA SYSTEM

This application is based on provisional application No. 60/175,383 filed Jan. 11, 2000.

BACKGROUND OF THE INVENTION

1. Field of the Invention

This invention relates to an antenna system having multiple reflector antenna units in tandem and more particularly to such a system suitable in mobile installations for transmitting signals to and receiving signals from a satellite.

2. Description of the Related Art

Prior art antennas used in mobile installations for communications with satellites generally utilize a single feed unit which has a parabolic reflector. In order to attain the needed gain a reflector of fairly large dimensions is needed. The installation of a large reflector on a vehicle poses problems from the point of view of the air resistance when the vehicle is moving as well as the limited space available on most vehicles.

To Applicant's knowledge, no prior art parabolic reflector antenna systems have been developed to cope with this problem. Low profile hemispherical Luneberg lens systems employing multiple antenna units are described in U.S. Pat. No. 5,781,163 issued Jul. 14, 1998 to Ricardi, et al. and assigned to Datron/Transco,Inc., the assignee of the present application and U.S. Pat. No. 3,386,099 issued May 28, 1968 to Walter, et al. Both of these patents are directed to Luneberg lens antenna systems and no reference is made to antennas employing parabolic reflectors.

SUMMARY OF THE INVENTION

The device of the present invention is an improvement over the prior art in that it provides a less bulky antenna system having lower air resistance which is particularly suitable for use on vehicles. Multiple parabolic reflector antennas are joined together on a common base and are driven in tandem to desired positions both in azimuth and elevation by a common drive unit. Similar antenna units are mounted adjacent to each other and directed in the same direction for receiving and transmitting signals from and to a satellite. The signals from each antenna unit are phase shifted as needed in a combiner unit which combines such signals in-phase with each other. In this manner, high gain is achieved without the need for a single large diameter reflector.

It is therefore an object of this invention to provide an improved parabolic reflector antenna system for use on a vehicle which can be used to communicate with a satellite;

It is a further object of this invention to provide an antenna system employing a parabolic reflector having less bulk and providing less air resistance than prior art such systems;

Other objects of the invention will become apparent in view of the following description taken in connection with the accompanying drawings.

DETAILED DESCRIPTION OF THE INVENTION

Referring now to the FIGS, a preferred embodiment of the device of the invention is shown. Parabolic reflectors 11*a* are all connected to a common support mount 14. The support mount and along with it the reflectors are driven together in tandem in azimuth and elevation by means of azimuth and elevation positioners 15 which may be a conventional motor driven such positioner. Feed elements 11 are mounted in the centers of reflectors 11*a* and may comprise conventional wave guide feeds.

It is essential for efficiency of operation that the signals received by the antenna units and transmitted thereby be in phase with each other. This end result is achieved by means of combiner unit 12 shown in detail in FIG. 4.

Figure 1:
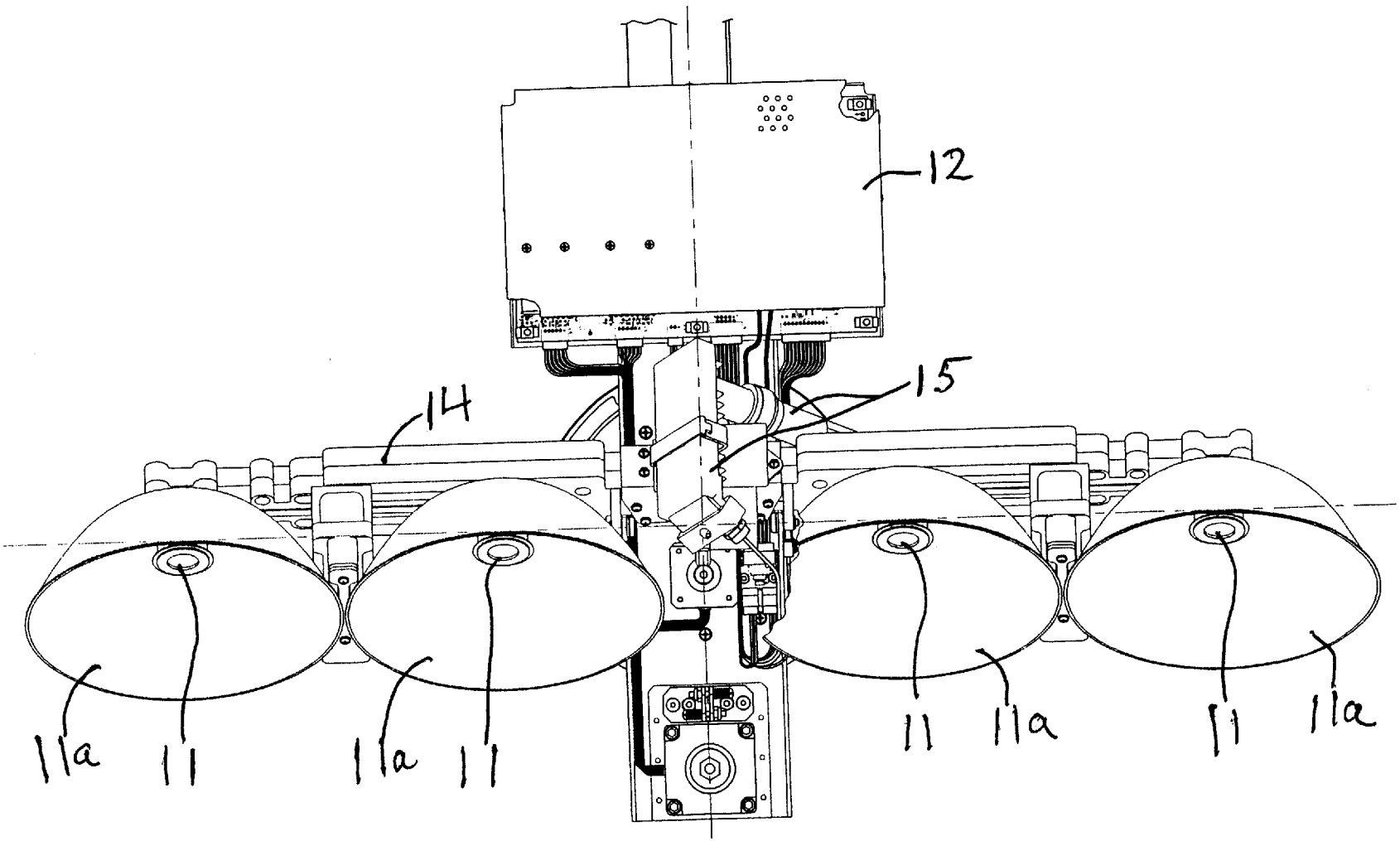
FIG. 1 is a front top perspective view of a preferred embodiment of the invention.
Figure 2:
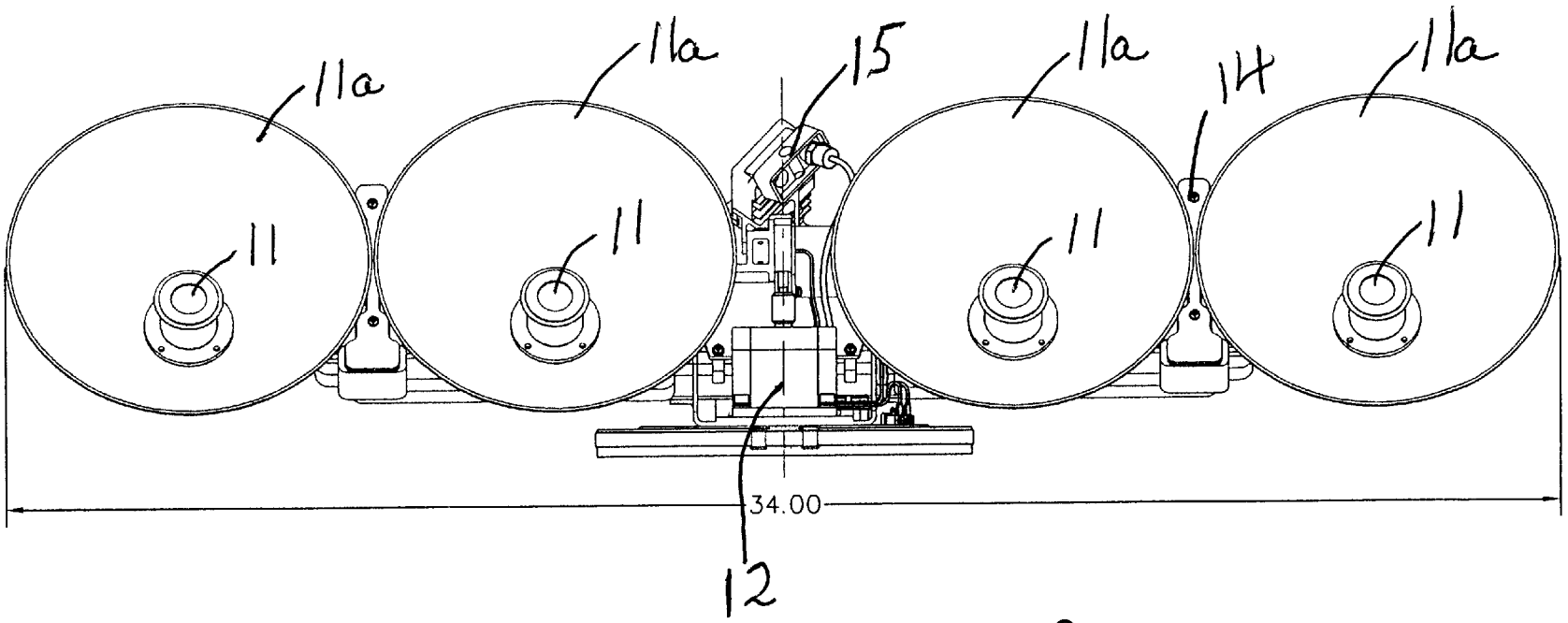
FIG. 2 is a front perspective view of the preferred embodiment.
Figure 3:
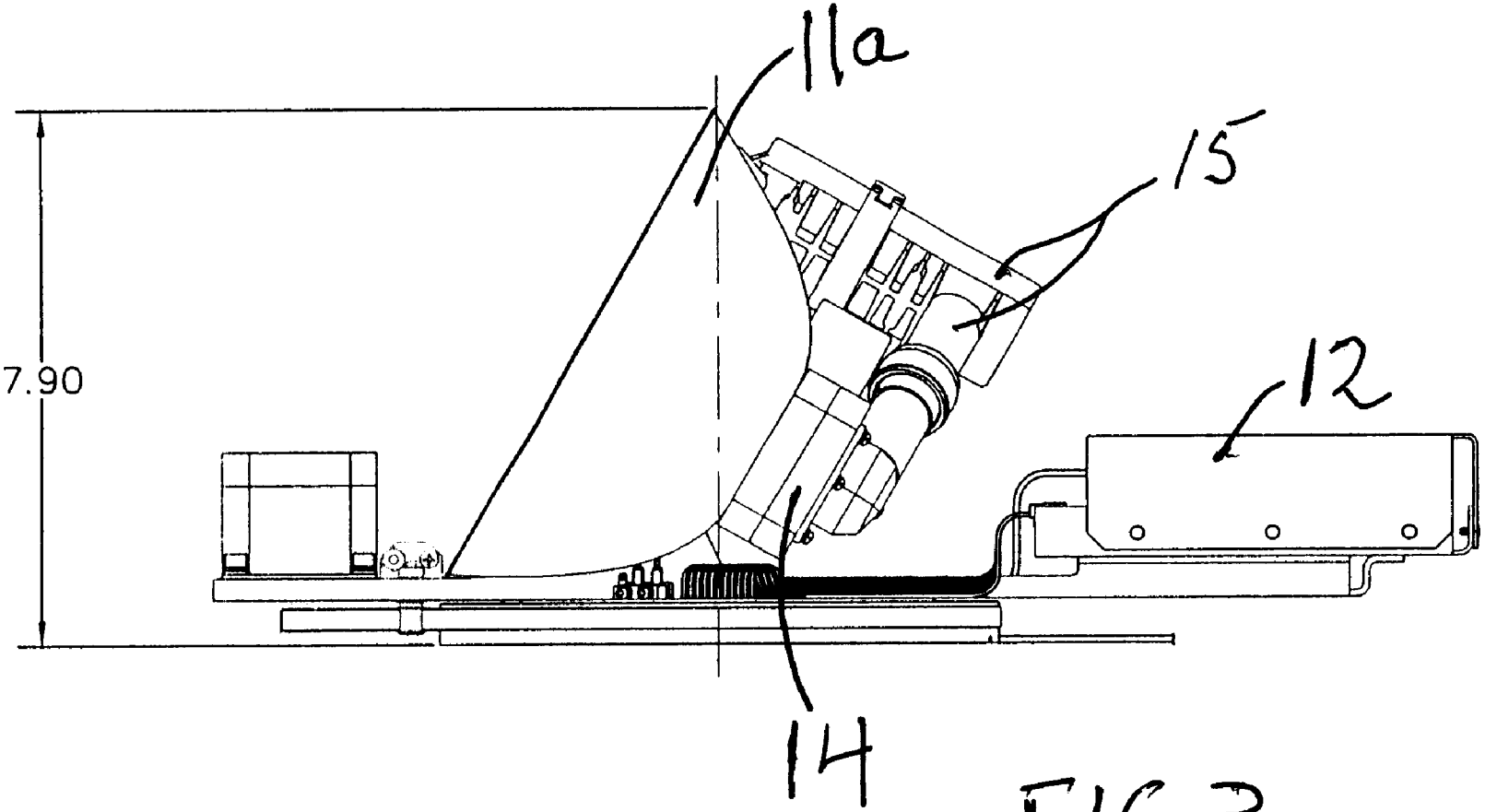
FIG. 3 is a side elevational view of the preferred embodiment.
Figure 4:
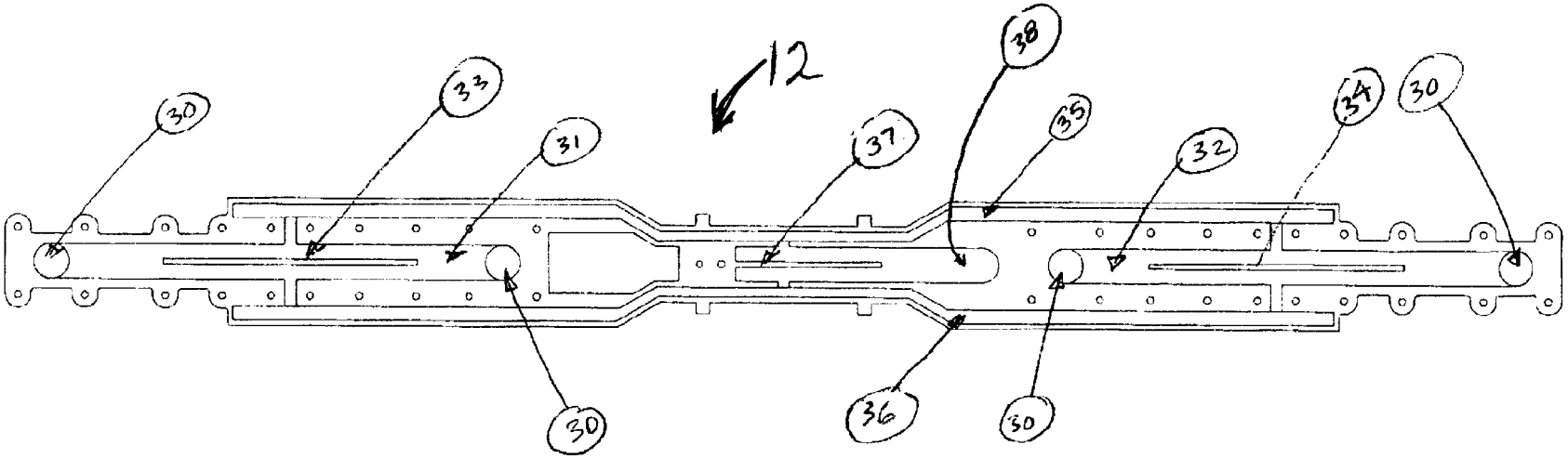
FIG. 4 is a side view of the combiner unit of the preferred embodiment.

Referring to FIG. 4, the combiner of the preferred embodiment is in the form of a wave guide. The output of each antenna feed element 11 has Left or Right Hand Circular Polarization(LHCP or RHCP). The output 11 of each antenna is fed into one of the apertures 30 formed in the wave guide. A first and second pair of reflectors 31 and 32 are each combined in a separate wave guide channel and the polarization of the waves fed thereto converted from circular to linear polarization by means of septum polarizers 33 and 34, respectively. The Vertical and Horizontal polarized waves are then fed to wave guide channels 35 and 36 where they are further combined. The outputs of channels 35 and 36 are now fed to septum polarizer 37 of wave guide channel 38 where they are transformed back to their original circular polarization and appear as combined circularly polarized waves in channel 38. The output of channel 38 is suitable for input into a slightly modified COTS Low Noise Block Converter which is an off the shelf item.

It is to be noted that the number of antennas combined could be anywhere between 2 to 8 or more utilizing the same basic combiner circuit topology. Further the combiner need not be formed from a wave guide but could use other approaches such as phase matched coaxial cables, stripline circuits, a coaxial line in an airgap wave guide or a combination of the above indicated devices. Also the polarizers could be formed from other than septum polarizers such as, for example, 0/90 hybrid circuits.

While the invention has been described and illustrated in detail it is to be understood that this is intended by way of illustration and example only, the scope of the invention being limited by the terms of the following claims.

We claim:

1. An antenna system for communicating with a satellite comprising:

a plurality of similar antenna units for receiving and transmitting signals at a common frequency employing signal feeds and parabolic reflectors;

said antenna units being adjacent to each other and facing in the same direction;

drive means for driving said antenna units in elevation and azimuth in tandem; and combiner means for combining signals received by said antenna units to bring such signals into phase with each other, said combiner means including a combiner unit for transforming said signals from circularly to linearly polarized form and combining said linearly polarized signals.

2. The antenna system of claim 1 wherein there are at least four of said antenna units.

3. The antenna system of claim 1 wherein said antenna units are joined together on a common base.

4. The system of claim 1 device of claim 1 wherein said drive means comprises a common drive for driving all of said antenna units simultaneously.

5. A method for bringing the signals received from a common source, at a common frequency by a plurality of antenna units having parabolic reflectors into phase with each other comprising the steps of:

placing said antenna units adjacent to each other and driving said units in azimuth and elevation in tandem to bring them in line with said source; and combining the signals received by said antenna units in a combiner.

* * * * *